United States Patent [19]

Jonas et al.

[11] Patent Number: 4,880,224

[45] Date of Patent: Nov. 14, 1989

[54] ROWING MACHINE

[76] Inventors: Werner Jonas, 1142 Ave. Des Erables, Apt. #1, Quebec, Quebec, Canada, G1R 2N2; Nathanial B. Findlay, 1045 Belvedere Ave., Apt. #226, Quebec, Quebec, Canada, G1N 4L4

[21] Appl. No.: 259,737

[22] Filed: Oct. 19, 1988

[51] Int. Cl.[4] ..... A63B 69/06

[52] U.S. Cl. ..... 272/72

[58] Field of Search ..... 272/69, 70, 71, 72, 272/73, 128, 132, 134; 74/801; 128/25 R, 25 B

[56] References Cited

U.S. PATENT DOCUMENTS

| | | | |
|---|---|---|---|
| 2,725,231 | 11/1955 | Hoover | 272/72 |
| 3,265,362 | 8/1966 | Moody | 74/801 X |
| 3,940,989 | 3/1976 | Engerstam | 272/73 X |
| 3,964,742 | 6/1976 | Carnielli | 272/73 |
| 4,047,715 | 9/1977 | Gjessing | 272/72 X |
| 4,084,810 | 4/1978 | Forsman | 128/25 R X |
| 4,396,188 | 8/1983 | Dreissigacker et al. | 272/72 |
| 4,452,445 | 6/1984 | Csekes | 272/73 |
| 4,632,386 | 12/1986 | Beech | 272/73 |
| 4,678,184 | 7/1987 | Neiger et al. | 272/132 X |
| 4,705,269 | 11/1987 | DeBoer et al. | 272/73 |
| 4,718,665 | 1/1988 | Airy et al. | 272/132 |
| 4,765,615 | 8/1988 | Case | 272/132 |
| 4,772,013 | 9/1988 | Tarlow, Jr. | 272/72 |
| 4,776,587 | 10/1988 | Carlson et al. | 272/134 X |
| 4,789,153 | 12/1988 | Brown | 272/72 |

FOREIGN PATENT DOCUMENTS

| | | | |
|---|---|---|---|
| 1183559 | 3/1985 | Canada | 272/72 |
| 0214748 | 3/1987 | European Pat. Off. . | |
| 545958 | 2/1932 | Fed. Rep. of Germany | 272/72 |
| 3404562 | 8/1985 | Fed. Rep. of Germany | 272/73 |
| 8701953 | 4/1987 | PCT Int'l Appl. | 272/73 |
| 1248615 | 8/1986 | U.S.S.R. . | |
| 2175813 | 12/1986 | United Kingdom | 272/72 |

*Primary Examiner*—Richard J. Apley
*Assistant Examiner*—Robert W. Bahr
*Attorney, Agent, or Firm*—Samuel Meerkreebs

[57] ABSTRACT

A frame member has a seat mounted thereon, the seat being movable therealong. The frame member also carries feet rests. A shaft is mounted across the frame member at one end thereof, and a flywheel is mounted on the shaft. A planetary gear system having a rotatable carrier, pinion gears mounted in the carrier, a stationary ring gear and a central gear is mounted on the shaft for rotatably driving the flywheel. The central gear is mounted on the shaft for rotation therewith. A spool is mounted on the carrier for rotation therewith. A cable is wound around the spool for providing rotary motion to the spool when the cable is pulled by an exerciser during the rowing stroke. Thus, the rotary motion of the spool is transferred to the flywheel through the planetary gear system and the shaft in a speed increasing mode.

3 Claims, 2 Drawing Sheets

ROWING MACHINE

BACKGROUND OF INVENTION

1. Field of the Invention

The invention relates to a stationary rowing machine exercising device. More specifically, the invention relates to such a device which simulates the resistance to be overcome in a real-life rowing environment.

2. Description of Prior Art

One such rowing device is illustrated in U.S. Pat. No. 4,396,188, Dreissigacker et al, Aug. 2, 1983, which is exemplary of similar devices also taught in the art. However, it differs from these other devices by using an elastic return means, which is connected to the drive means beyond where the drive means interconnects with a plural gearing means, for returning the handle during the return stroke. In addition, the force for driving the flywheel is applied directly to the shaft of the flywheel without the intervention of either speed increasing or reduction means.

British Patent Application No. 2 175 813A, European Patent Application No. 214-748-A, and U.S. Pat. No. 2,725,231, Hoover, Nov. 29, 1955, also teach rowing machines. However, in these machines, the return means is a spring which is wound up during the rowing stroke and which unwinds to return the drive means during the return stroke.

U.S. Pat. No. 4,452,445, Csekes, June 5, 1984, U.S. Pat. No. 3,964,742, Carnielli, June 22, 1976, and USSR Patent No. 1248-615-A, teach exercising devices which have a rotating shaft connected to foot pedals. The central gear of a planetary gear system is connected to the shaft to rotate therewith, and the carrier of the planetary gear system is connected to an outer wheel, whereby rotary motion of the shaft is transmitted to the outer wheel in a speed reduction mode.

SUMMARY OF INVENTION

It is an object of the invention to provide a stationary rowing machine exercising device which includes a flywheel for simulating resistance to be overcome wherein the means for returning comprises a clock spring mounted on the same shaft as the flywheel.

It is a further object of the invention to provide a stationary rowing machine exercising device which uses a planetary gear system to transmit motion of a drive means to the flywheel through a planetary gear system in a speed increasing mode.

In accordance with the invention there is provided a stationary rowing machine exercising device comprising a frame member and seat means mounted on the frame member and movable therealong. Foot rest means are connected to the frame member so that an exerciser can rest his feet on this foot rest means. A shaft is mounted across the frame at one end thereof. A flywheel is mounted on the shaft. Means for rotatably driving the flywheel are also mounted on the shaft. The means for rotatably driving comprise a planetary gear system having a rotatable carrier, pinion gears mounted in the carrier, a stationary ring gear and a central gear. The central gear is mounted on the shaft for rotation therewith. Spool means are mounted on the carrier for rotation therewith, and cable means are wound around the spool means for providing rotary motion to the spool means when the cable means is pulled by an exerciser during a rowing stroke. Thus, the rotary motion of the spool means is transferred to the flywheel, through the planetary gear system and the shaft, in a speed increasing mode.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
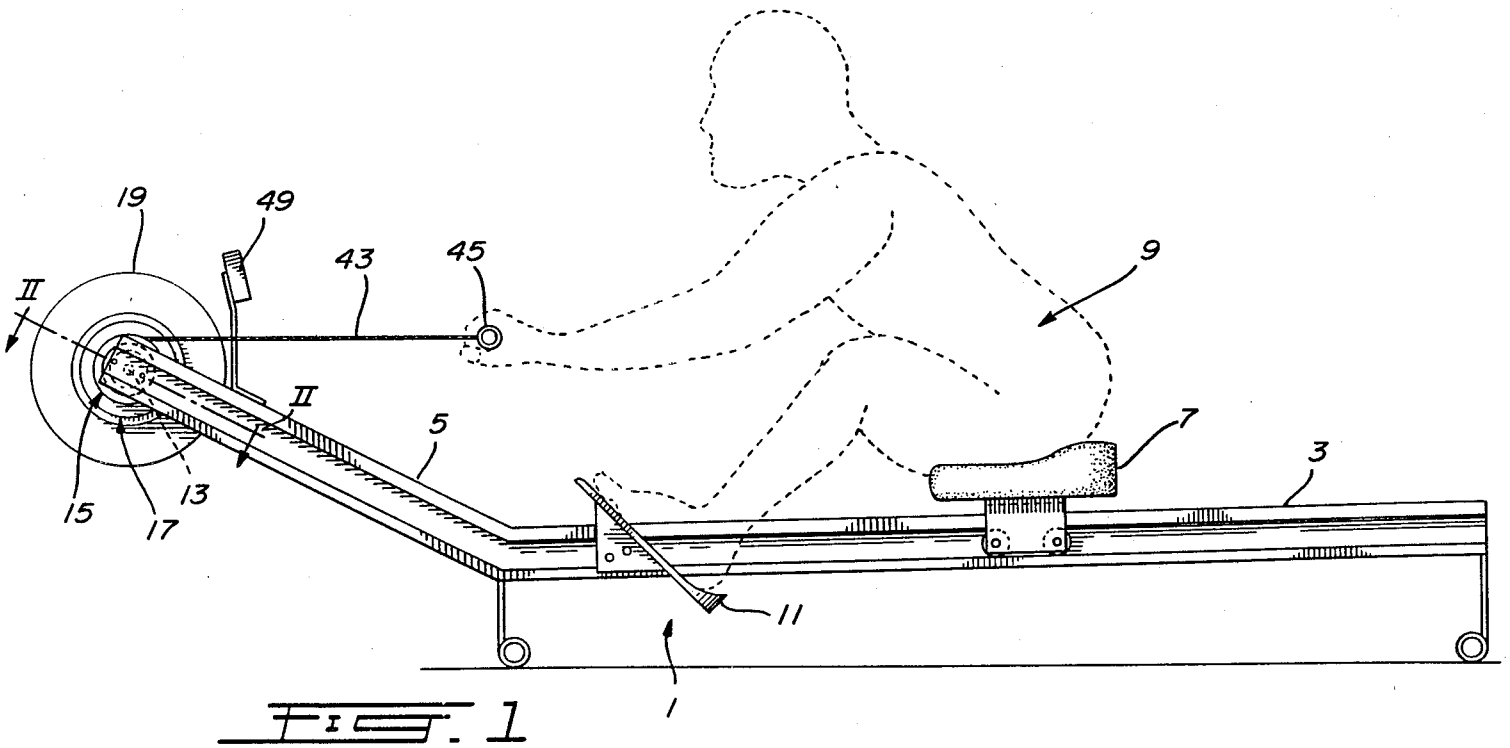
FIG. 1 is a side view of the stationary rowing machine exercising device in accordance with the invention.

Turning now to the drawings, the exercising device comprises a frame, illustrated generally at 1, and including a horizontally extending portion 3 and an upwardly extending portion 5. Seat 7 is mounted on the horizontally extending portion 3 and is movable therealong. An exerciser 9 seats himself on the seat 7 and supports his feet in feet rests 11.

Figure 2:
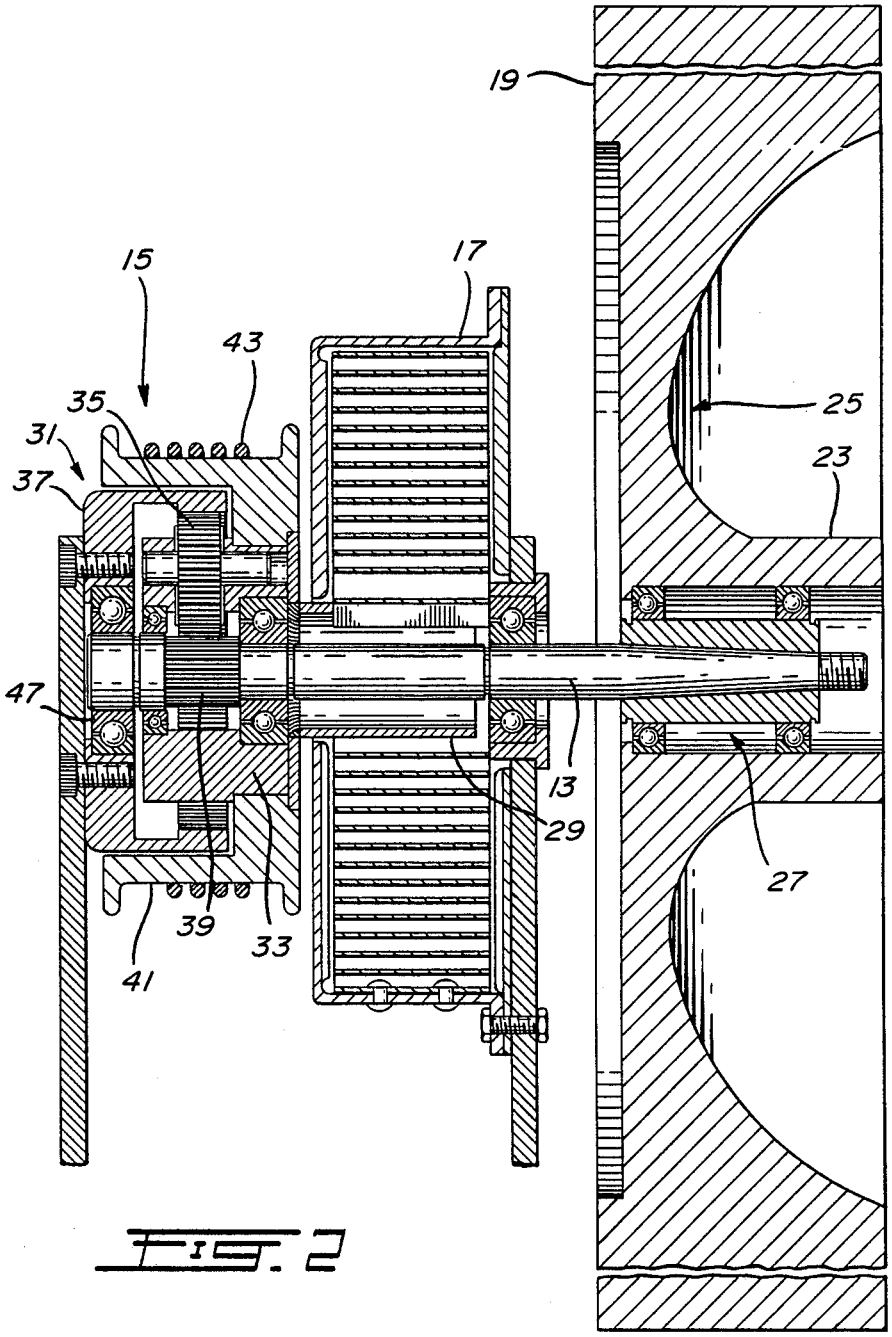
FIG. 2, which is a section through II—II of FIG. 1, illustrates the drive means and the return means in accordance with the invention.

Extending across the outer end of the upwardly extending portion 5 is a shaft 13 (see also FIG. 2). Mounted on the shaft 13 are a means 15 for driving flywheel 19 and a means 17 for returning the flywheel 19 as will be described below.

The flywheel 19 comprises a plurality (eight shown in the drawings) of blades 21 to 21K disposed with equal increment around the flywheel 19. As will be appreciated by one skilled in the art, the flywheel 19 will present resistance to rotation to simulate the resistance experienced when driving oars through water.

Turning now to FIG. 2, flywheel 19 has, at the center thereof, a hub 23 and, in the sides of the vanes or blades 21 to 21K thereof, a circular indent 25 and supporting bearings on either side. Mounted in the hub 23 is a one-way clutch 27. The free end of shaft 13 is connected to the flywheel through the one-way clutch 27. The one-way clutch 27 will connect the shaft 13 to the flywheel 19 for rotation therewith during a rowing stroke, but will disengage the shaft 13 from the flywheel 19 during a return stroke so that the flywheel 19 will not rotate with the shaft 13 during the return stroke.

Spring 17 also includes a hub 29 which is connected to carrier 33 for rotation therewith. During the rowing stroke, the spring 17, which preferably comprises a clock spring, will "wind up". Accordingly, during the return stroke, the spring will unwind to return the means for driving as will be described below.

The means 15 for driving the flywheel 19 comprises a planetary gear system, illustrated generally at 31, and including a carrier 33 which carries pinion gears 35 (usually 3). The teeth on the pinion gears 35 mesh with the teeth of an inner gear on ring gear 37, and also with the teeth on central gear 39. Central gear 39 is connected to shaft 13 for rotation therewith.

Mounted on the carrier 33 for rotation therewith is a spool 41, and cable 43 is wrapped around the spool 41. As seen in FIG. 1, the free end of the cable 43 is connected to a handle 45 which is grasped by the exerciser and pulled by him to rotate spool 41.

The end of shaft 13 is mounted in a bore of the ring gear 37 on bearings 47 so that the shaft rotates relative to the ring gear 37, i.e., the ring gear 37 is stationary relative to the shaft 13.

In operation, the exerciser grasps the handle 45 and, in simulation of a rowing stroke, pulls the cable 43 in the direction of the arrow A unwinding the cable 43 from the spool 41. The spool 41 will accordingly rotate in a clockwise direction in FIG. 1.

Rotation of the spool 41 will cause a similar rotation of carrier 33, which is connected to the spool 41, causing the centers of the pinion gears 35 to rotate, with the carrier 33, about the axis of the carrier 33. During the rotation of the centers of the pinion gears 35, and because the teeth of the pinion gears 35 engage the inner teeth of the stationary ring gear 37, the pinion gears 35 will also rotate about their own axis in a counter-clockwise direction.

The rotation of the pinion gears 35 about their own axis will cause the central gear 39 to also rotate, in a clockwise direction, because of the meshing between the teeth of the pinion gears 35 and the teeth of the central gear 39. As the central gear 39 is attached to the shaft 13, the shaft 13 will also rotate in a clockwise direction. Thus, the rotary motion of the spool is transferred to the shaft 13.

Because the size of central gear 39 of the shaft 13, relative to the sizing of pinion gears 35 and ring gear 37, the shaft 13 will rotate at a greater speed than the spool 41. In a specific embodiment, there is a 6:1 increase in rotary speed from the spool 41 to the shaft 13.

One-way clutch 27 is adapted to engage when shaft 13 rotates in a clockwise direction, and to disengage when shaft 13 rotates in a counter-clockwise direction. Thus, flywheel 19 will be connected to shaft 13 when the exerciser is pulling cable 43 in the direction of arrow A, i.e., during a rowing stroke.

At the same time, when shaft 13 is rotating in a clockwise direction, spring 17 is being wound up.

When the end of the rowing stroke is reached, the exerciser leans forward in the direction opposite to the arrow A. Release of force on the cable 43 will permit spring 17 to unwind thus driving carrier 33 in a counter-clockwise direction. When the carrier 33 is rotating in the counter-clockwise direction, the pinion gears 35 will rotate to drive central gear 39, and therefore shaft 13, in the counter-clockwise direction.

When shaft gear 13 rotates in the counter-clockwise direction, clutch 27 disengages so that flywheel 19 does not follow the counter-clockwise rotation.

At the same time, the counter-clockwise rotation of carrier 37 is transmitted to spool 41 so that cable 43 will be rewound on spool 41.

When the end of the return stroke is reached, the exerciser will once again pull the cable 43 in the direction of arrow A in a rowing stroke, etc.

Because the rotary motion of the spool 41 is transferred to the flywheel 19 in a speed increasing mode during the rowing stroke, a smaller flywheel can be used. Accordingly, this arrangement is especially useful for a private home exercising device.

In addition, it simulates a real-life rowing environment in that the amount of force needed to increase speed at a high speed level is greater than the amount of force required to increase speed at a low speed level. That is, the force required to increase the speed from 900 revolutions per minute to 1000 revolutions per minute is greater than the force required to increase the speed from 100 revolutions per minute to 200 revolutions per minute even though the increment is the same in both cases. This is similar to the situation as it exists in a real-life rowing environment.

Thus, in a sense, the apparatus is self-adjusting in that, when the exerciser pulls harder, to thereby provide a higher rotational speed of the spool 41, he meets more resistance to counter his greater efforts. This is in contrast to exercising devices which use friction brakes set at a specific level. With the friction brake arrangement, a greater output of effort by the exerciser will not cause a greater resistance to that effort.

It is also contemplated, in accordance with the invention, to provide means 49 for displaying the speed of the flywheel. The means 49 can, for example, comprise a tachometer or other such means as is well known in the art.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A stationary rowing machine exercising device, comprising:

a frame member;

seat means mounted on said frame member and movable therealong;

feet rest means connected to said frame member;

a shaft mounted across said frame at one end thereof;

a flywheel mounted on said shaft;

means for rotatably driving said flywheel mounted on said shaft;

said means for rotatably driving comprising:

(i) a planetary gear system comprising:

(a) a rotatable carrier;

(b) pinion gears mounted in said carrier or on said carrier;

(c) a stationary ring gear;

(d) a central gear;

said pinion gears meshing with said central gear and said stationary ring gear;

(ii) said central gear being mounted on said shaft for rotation therewith;

(iii) spool means mounted on said carrier for rotation therewith;

(iv) cable means wound around said spool means for providing rotary motion to said spool means when said cable means is pulled by an exerciser during a rowing stroke;

whereby, said rotary motion of said spool is transferred to said flywheel, through said planetary gear system and said shaft, in a speed increasing mode.

2. A device as defined in claim 1 and further including a spring connected to said carrier;

whereby, said spring is wound up during said rowing stroke; and said spring is unwound during a return stroke to rotate said carrier in a direction opposite to the direction of rotation of said carrier during said rowing stroke whereby to rewind said cable means on said spool during said return stroke.

3. A device as defined in claim 2 wherein said flywheel comprises a central hub;

a one-way clutch in said central hub;

said shaft being disposed in said one-way clutch;

whereby, during said rowing stroke, said one-way clutch is engaged so that said shaft is connected to said flywheel and said flywheel rotates with said shaft; and during said return stroke, said clutch is disengaged so that said flywheel is disconnected from said shaft and does not rotate with said shaft during said return stroke.

* * * * *